US007047803B1

(12) United States Patent
Hill

(10) Patent No.: US 7,047,803 B1
(45) Date of Patent: May 23, 2006

(54) METHOD FOR SITING AND OPERATING AN ODOR DISPERSING WIND MACHINE ARRAY

(76) Inventor: Daryl G. Hill, 12814 Rutherford Rd., Yakima, WA (US) 98903

( * ) Notice: Subject to any disclaimer, the term of this patent is extended or adjusted under 35 U.S.C. 154(b) by 0 days.

(21) Appl. No.: 11/069,898

(22) Filed: Feb. 28, 2005

(51) Int. Cl.
*A63B 53/00* (2006.01)

(52) U.S. Cl. ..... 73/170.01

(58) Field of Classification Search ..... 73/170.01
See application file for complete search history.

(56) References Cited

U.S. PATENT DOCUMENTS 2,712,714 A * 7/1955 McGee ..... 47/2
4,166,222 A * 8/1979 Hanley ..... 290/55
5,583,045 A * 12/1996 Finn ..... 435/290.1
5,736,049 A * 4/1998 Bundy et al. ..... 210/620
6,132,181 A * 10/2000 McCabe ..... 417/334
6,254,776 B1 * 7/2001 Seagle ..... 210/603
2004/0047733 A1 * 3/2004 Gasendo ..... 416/120

* cited by examiner

*Primary Examiner*—Max Noori
*Assistant Examiner*—Alandra Ellington
(74) *Attorney, Agent, or Firm*—Stration Ballew PLLC

(57) ABSTRACT

A method for arranging and operating an array of wind machines to disperse area-wide odors, as generated by municipal waste treatment facilities and the like. The method includes a wind machine positioned to force air across the odor source. The wind machine is preferably a propeller/tower configuration, and most preferably configured for high volume and low RPM operation, to minimize noise. The method also includes the steps of sensing ambient meteorological and plant operation conditions in real time and operating the wind machines in response to stagnant, odor producing conditions. Multiples of wind machines are employed in the preferred embodiment of the method, the siting of the wind machines based upon topographic and historical meteorological conditions. The wind machines can respond to the odor by varying operating parameters such as air flow direction, speed and blade pitch.

8 Claims, 4 Drawing Sheets

METHOD FOR SITING AND OPERATING AN ODOR DISPERSING WIND MACHINE ARRAY

TECHNICAL FIELD

The invention relates to a method for arranging and operating an array of wind machines to disperse area-wide odors. Specifically, invention includes siting a multiple of wind machines, positioned to force air across the odor source, as generated by municipal waste treatment facilities and the like.

BACKGROUND OF THE INVENTION

The control of odor through the dilution and air movement effects of fans is well known. This "mixed air flow" technology reduces the impacts of odors, such as those generated by waste water treatment facilities. However, this technology is conventionally applied in vented applications for enclosed buildings and structures, not in problem "area sources," as found in open lagoons and trickle ponds. Certain meteorological factors make the control of area sources difficult, such as lagoons and aerated surfaces and material piles. A system is needed that responds to the natural meteorological conditions, such as wind, temperature and humidity, in the control of area source odors.

U.S. Pat. No. 4,513,529 discloses a method for preventing frost damage to crops that includes a suggestion of placing an array of ground level temperature sensors in an orange grove to detect the need for freeze protection. This approach is rudimentary, and only addresses temperature, with the use of pole mounted lights to indicate the need for air movement action by use of helicopter. A system is needed that improves upon such a sensor system, to somehow operate odor control, over an area of odor generation, as opposed to control at a stack or vent.

The invention will be better understood by reference to the following detailed description taken in conjunction with the accompanying drawings.

DETAILED DESCRIPTION OF SPECIFIC EMBODIMENTS

The invention provides an operational method for a wind machine array, and more particularly the operation of a wind machine array system that disperses odors, as typically generated in waste water treatment facilities. Features of the operational method are shown in FIGS. 1 through 4.

Figure 1:
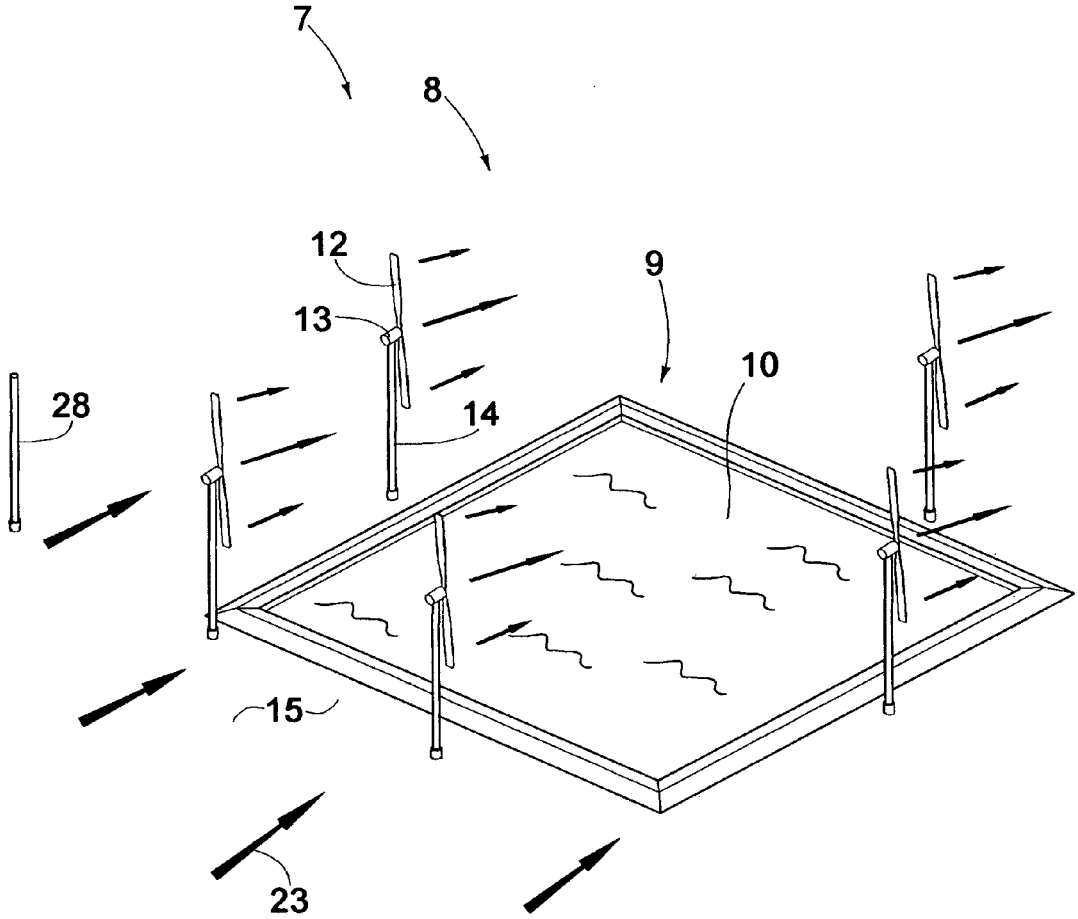
FIG. 1 is a perspective view of an odor dispersing wind machine array, according to an embodiment of the invention.
Figure 2:
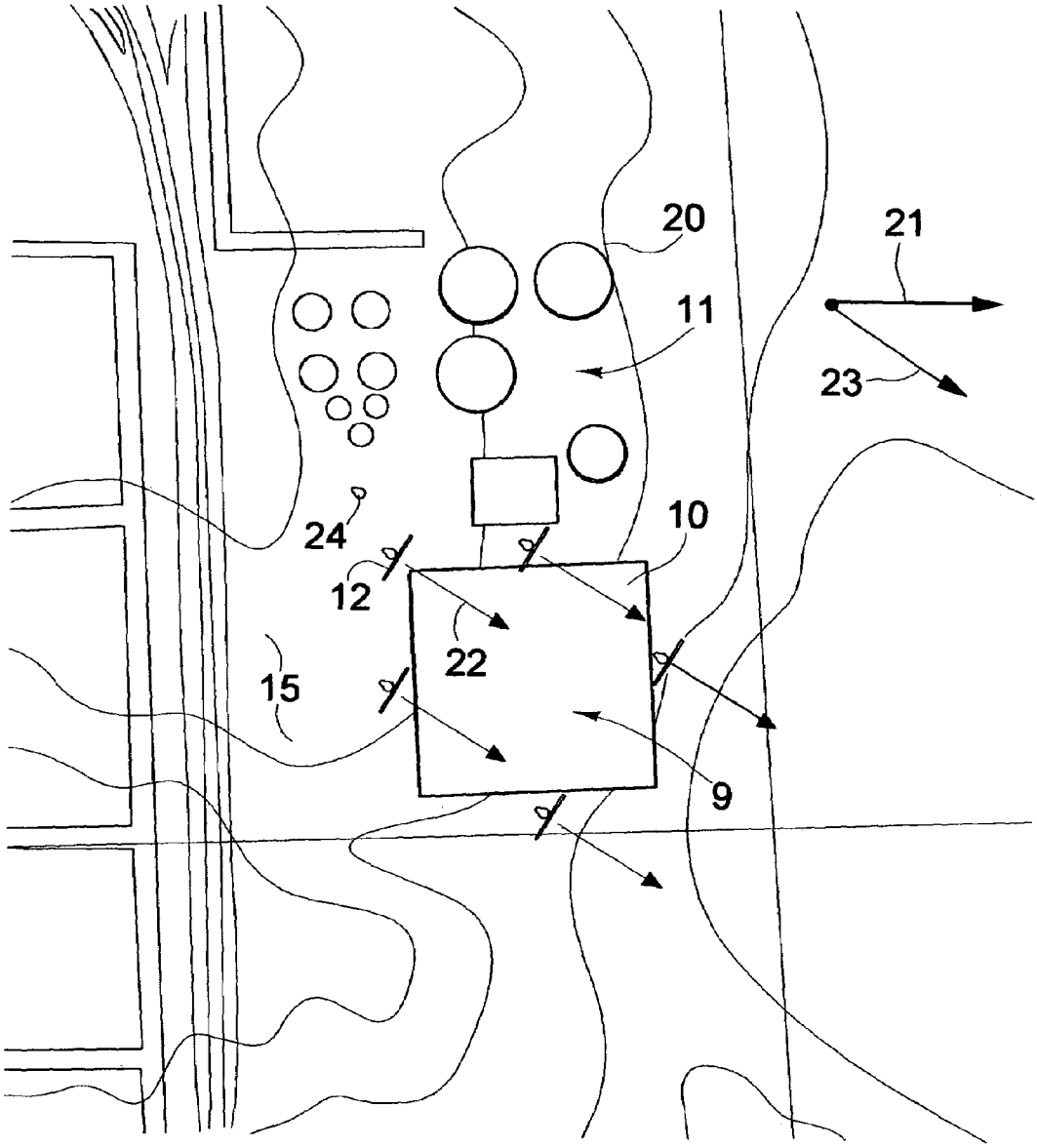
FIG. 2 is a mapped, plan view of an odor dispersing wind machine array, according to an embodiment of the invention.

FIGS. 1 and 2 shows a wind machine array 7, the wind machine array composed of a multiple of wind machines 8, positioned about an odor source 9. The odor source is most preferably a storage lagoon 10 of a waste water treatment facility 11, as shown in FIG. 2. The operation of each wind machine in the wind machine array is controlled, as further discussed herein, to function in concert with all of the wind machines in the array, to optimize the odor control effects of the wind machine array. As shown in FIG. 1, each of the multiple of wind machines preferably includes a propeller 12 mounted to a motor 13. The motor preferably mounts upon a tower 14, and the tower is planted most preferably into a ground surface 15.

Figure 3:
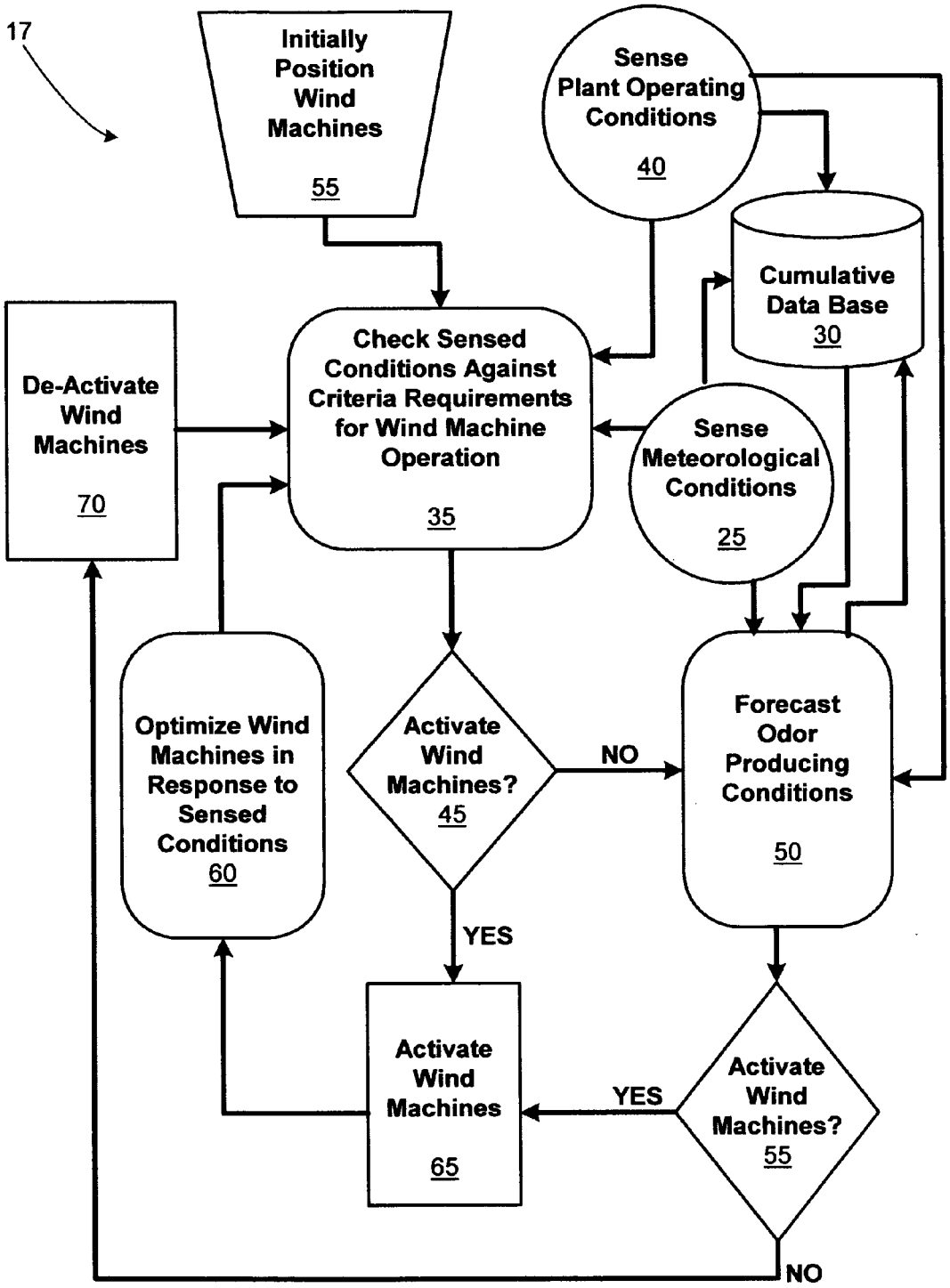
FIG. 3 is a logic flowchart of a method for siting and operating an odor dispersing wind machine array, according to an embodiment of the invention.

FIG. 3 schematically overviews a method of operation 17 of the multiple of wind machines 8 in the wind machine array 7, according to a preferred embodiment of the present invention. The method of operation first includes an initial positioning of the multiple of wind machines 18, proximate to the odor source 9. This initial positioning of the multiple of wind machines may also be referred to as a "siting step."

The odor source 9 is surrounded by topography. Conventionally, topography can be described from the plan or overhead view with the use of a contour 20, as shown the map view of FIG. 2. The contour is a line or curve of constant elevation. The siting step includes a review of these topographic contours and mapped features. FIG. 1 also shows a downhill slope direction 21. It is known to those skilled in meteorology that in the absence of intervening frontal flow, especially in calm atmospheric conditions, cooler air typically seeks lower elevations and its flow will follow the downhill slope direction. The multiple of wind machines 8 are preferably positioned to take advantage of this "downslope flow," so that the air flow induced by the wind machine is enhanced, rather than hampered or possibly canceled by this natural movement of air. As evident in FIG. 1, the downhill slope direction or downslope flow direction, is determined by the simple construction of a perpendicular to the contours, in the direction of decreasing elevation trend. The wind machines each include a direction of generated wind flow 22. The wind machine's direction is preferably parallel to the downhill slope direction to take advantage of this natural flow.

A predominant wind direction 23, as also shown in FIG. 2, is another factor that is preferably considered in the siting step 18, for the multiple of wind machines 8. To determine the predominant wind direction for a particular site under varied conditions, a meteorological telemetry station 24 is preferably utilized. The meteorological telemetry station, can be located above the ground surface 15, on a "met" tower 26, which is a standard meteorological instrument mounting tower, as shown in FIG. 1. At a minimum, the telemetered data most preferably includes surface wind direction, wind speed and temperature, all monitored at regular intervals. Also alternatively, one of the towers 14 of the multiple of wind machines 8 can be utilized for the meteorological telemetry station. However, when the meteorological telemetry station is incorporated within one of the wind machine towers, the telemetered data can be obscured when the wind machine is in operation. When used, as preferred, the separate, stand alone met tower can also be employed to monitor the weather parameters near the height of the wind machines. A wind direction, wind speed and temperature telemetry, in real time, aids in the siting of the multiple wind machines. These weather parameters are helpful in positioned to track and take advantage of predominant wind directions, especially during stagnant periods, so that the air flow induced by the wind machine is enhanced, rather than countered or possibly canceled by these natural wind and air flows.

Additionally, as a recommended part of the initial siting step 18, the multiple of wind machines 8 are selected to provide the highest volume of airflow, at the lowest operational noise levels. The "Agri-Cool™" wind machine with a propeller 12 having "high volume" characteristics, as manufactured by Orchard Rite, LTD. of Yakima Wash., USA, is a preferred wind machine selection.

In a preferred operational method 17 of the wind machine array 7, the meteorological telemetry station 24 is employed in a sensing of a real time ambient meteorological condition 25. As preferred, the meteorological telemetry station includes a meteorological sensor 26, in communication with a meteorological or meteorology data logger 27. Most preferably, the meteorological sensor is mounted on the met tower 28, or alternatively, one of the multiple of wind machines 8, while the meteorological data logger is mounted nearby, within a weather-proof enclosure that is easily accessible. The meteorology sensor preferably includes a wind speed sensor and wind direction indicator, or anemometer, and an air temperature, and an air moisture humidity sensor or hydrometer. The selection and configuration of these meteorological sensors are well known to persons skilled in the remote site automated gathering of meteorological data.

As most preferred, the meteorological sensor 26 transmits a low voltage signal for each sensed parameter to the meteorology data logger 27. The meteorology data logger, well known to those skilled in the field of weather monitoring and telemetry, organizes and temporarily stores the data acquired from the meteorological sensor specific, and relays this time tracked data to the operating system 33. The operating system then uses the telemetered information and archives it in a cumulative data base 30.

Similar to the meteorology data logger 27, a wind machine data logger 31 is preferably employed to monitor the operational parameters of each of the multiple of wind machines 8 in the wind machine array 7. Each wind machine preferably includes sensors that provide for the transmission of low voltage signal for each sensed parameter to the wind machine data logger. Acquired telemetry preferably includes the direction of the wind machine, rotational speed, maintenance or mechanical alarms, and propeller trim and speed. The wind machine data logger, also well known to those skilled in the field of mechanical device monitoring and telemetry, organizes and temporarily stores the data acquired from the wind machines, and relays this time tracked data to the operating system 33. The operating system then uses the telemetered information and archives it in the cumulative data base 30.

Figure 4:
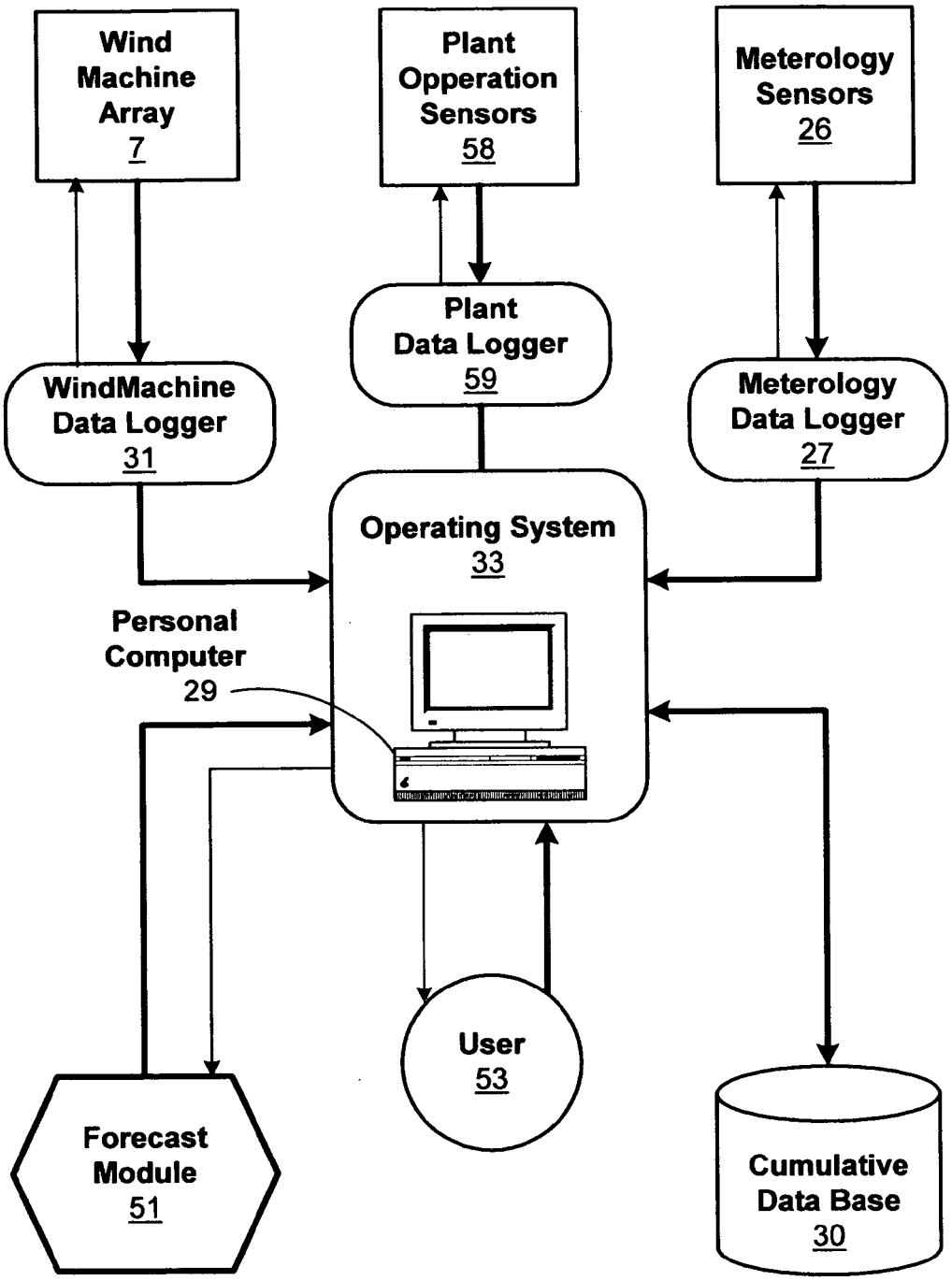
FIG. 4 is a schematic chart of the elements of a method for siting and operating an odor dispersing wind machine array, according to an embodiment of the invention.

The cumulative data base 30 preferably provides an archive for all plant, meteorological and wind machine operation information for use by the operating system 33. The operating system is preferably run on a personal computer 29, as shown in FIG. 4. The operating system most preferably includes a relational architecture, which provides access to the archived information through specifically formatted queries and data mining techniques, well known to data processing professionals.

The operating system 33 has four primary tasks. Two of these tasks relate to the activation of the wind machine array 9. The operating system checks sensed conditions against criteria requirements for wind machine operation 35, as shown in FIG. 3. From a sensing of plant operation conditions 40 and the sensing of meteorological conditions 25, the operating system can make a decision whether to activate wind machines 45. If specific plant and meteorological conditions are satisfied, the decision can be made to activate the wind machines 65. The monitored plant operating conditions that are valuable in the decision to activate the wind machines, include the temperature and quantity of the plant effluent introduced into the storage lagoon. The sensed meteorological conditions considered in the decision to activate of the wind machine array, include low wind speed with a corresponding drop in ambient temperature. Wind direction may also be an important factor. The direction of sensitive receptors off site and the natural downslope airflow can be considered by the operating system.

For effective response to sensed changes in plant operation and meteorological conditions, the initiation or siting of the wind machine array 7 is preferably accomplished as discussed above, with an initial positioning of the wind machines 55, which includes a review of the topographic contours 20 and mapped features. Again, the multiple of wind machines 8 are preferably positioned to take advantage of the "downslope flow," in additional consideration of the historic meteorological trends and patterns for the odor source 9. As shown in FIG. 3, the initial positioning of the wind machines is a critical first step to the operation of the wind machines in that this initial position factor into the decisions made by the operation method 17 in monitoring and then in operating the wind machine array. The cumulative data base 30, as shown in FIGS. 3 and 4, is preferably employed for the compilation of the historic and the archival storage of real-time telemetered meteorological data, as discussed above.

Additionally, the operating system 33 includes a predictive or forecasting component for activating the wind machines "pro-actively," in response to imminent odor producing conditions, before odors become a problem offsite. The sensing of plant operation conditions 40, most preferably in real time, is employed to check sensed provide criteria for the forecasting odor producing conditions 50. For a preferred embodiment of the present invention, the waste water treatment facility 11 is also monitored in real time. As shown in FIG. 4, plant operation sensors 58 are employed to aid in the sensing of plant operating conditions 40. The information gathered by these plant operation sensors is critical to the automated decisions regarding the operation of the wind machine array in that factors such as the temperature, flow rate, and biological oxygen demand are important in making such operational decisions. The information gathered by eh plant operation sensors is telemetered to a plant data logger 59. From the plant data logger, the information is routed to the operating system 33, where it is then compiled for archival storage in the cumulative data base 30.

The data amassed from the meteorological telemetry station 24 can be reviewed by a predictive program to forecast an odor producing condition 50. The predictive program may be referred to as a forecast module 51, as shown in FIG. 4. The forecast module of the predictive program is most preferably embodied within a personal computer (PC) based application, employing simple, monitoring and predictive algorithms, as are well known to those skilled in the art of data management in industrial settings for predictive operational functions. The PC including the operating system is interactively accessed by a user 53, located at the PC itself or located remotely, and communicating over the internet, or another appropriate network or communication system. The wind machine array is activated by the operating system if certain, pre-programed values or criterial criteria are met. These criteria may be any combination sensed variables, such as air temperature, wind speed, plant processing rates, time of day, wind direction, and storage lagoon temperature. Trends in any of these criteria or variables can also be tracked, as with a data analysis program within the operating system 33 and "mines the cumulative data base 30. This data analysis preferably employs pattern recognition features, as known to those skilled in data analysis using automated methods. An intelligent, learning supervisory control and data acquisition system is most preferred, as also known to those skilled in the field of automated data tracking and analysis. With data analysis programing, the occurrence of odor producing conditions is forecasted, when the sensed meteorological conditions 25, point to an odor producing condition.

After the operating system 33 activates the wind machines 65, the third primary task is preferably undertaken by the operating system includes optimizing the wind machines in response to sensed conditions 60. The meteorological telemetry station 24, which includes the meteorology sensors 26 is employed to provide for the sensing if meteorological conditions 25, which is employed to optimize the wind machines in response to the sensed conditions 60. Not only can this optimization include orienting the multiple of wind machines 8 in response to the real time ambient meteorological condition as sensed, but also in response to the real time condition of plant operation as sensed. The sensing of plant operating conditions 40 is similarly achieved with the use of the plant operation sensors 58, placed within the waste water treatment facility 11.

After the wind machine array 7 has been in operation for a period of time, the operational method 12 of the present invention can include de-activating the multiple of wind machines 70. As preferred, the de-activated state is the default or rest condition of the wind machine array, and the multiple of wind machines 8 are de-activated when the monitored criteria no longer meet the requirements for activation, and there is no longer the forecast of odor producing conditions 50. After the wind machines are de-activated, the operating system 33 reverts to a monitoring and forecasting mode, as regularly updated and the check of sensed conditions against criterial requirements 35 and the forecast of odor producing conditions continues.

In an alternative embodiment of the present invention, the operation of the wind machine array 7 can include the operation of a subset of the multiple of wind machines 8. This subset may be any number of the wind machines of the wind machine array, as determined to be adequate under the sensed conditions to meet the system's odor dispersion requirements.

Additionally, the multiple of wind machines 8 have operational parameters, which can be optimized for the best performance of each wind machine. In an additional, alternative embodiment of the present invention, the operational method 12 of the wind machine array 7 can include varying the operation parameters of each wind machine in response to the sensed conditions, to affect the optimum in reduction in odor. The operational parameters include wind machine orientation or air flow direction, speed of propeller rotation, and propeller blade pitch. Changes in these operational parameters results in changes in operational characteristics of any or all of the wind machines.

For example, if the operating system 33 determines that the sensed meteorological conditions require wind machine activation, but there is some air movement, the optimization of the wind machines in response to sensed conditions 60. May reduce the rotational speed of the propellers 12, to still provide for odor dispersion. Lower fan or propeller speed is desirable because at lower propeller speeds, less noise is produced by the wind machine operation. Alternatively, propeller pitch can also be adjusted with some types of wind machine propellers. Pitch can be adjusted in a tradeoff between efficiency and noise at a particular propeller speed. Residential neighborhoods are sensitive to fan noise, especially late at night and in early morning hours. Municipal noise ordinances, codes and operational agreements with these neighbors may require that certain maximum noise levels be observed and so limit the operational noise levels of the wind machine array 7.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A wind machine array method, comprising the steps of:

a) positioning a multiple of wind machines proximate to a water storage lagoon of a waste water treatment facility;

b) sensing a real time ambient meteorological condition;

c) sensing a real time condition of plant operation at the waste water treatment facility in real time;

d) checking sensed conditions against criteria for wind machine operation; and e) orienting the multiple of wind machines in response to the real time ambient meteorological condition, as sensed, and the real time condition of plant operation, as sensed.

2. The wind machine array method of claim 1, further comprising the steps of:

f) forecasting an odor producing condition; and g) orienting the multiple of wind machines in response to the forecast of the odor producing condition.

3. The wind machine array method of claim 2, further comprising the steps of:

h) varying an operation parameters of the wind machine in response to the sensed conditions to affect an optimum in forecasted odor producing condition reduction, the operational parameters of the wind machines including air flow direction, speed and blade pitch.

4. The wind machine array method of claim 2, further comprising the steps of:

h) varying an operation parameters of the wind machine in response to the sensed conditions to minimize noise produced by the wind machine array, the operational parameters of the wind machines including air flow direction, speed and blade pitch.

5. The wind machine array method of claim 1, further comprising the step of:

f) activating the multiple of wind machines in response to the real time ambient meteorological condition, as sensed, and the real time condition of plant operation, as sensed.

6. The wind machine array method of claim 1, further comprising the step of:

f) de-activating the multiple of wind machines in response to the real time ambient meteorological condition as sensed, and the real time condition of plant operation as sensed.

7. The wind machine array method of claim 1, further comprising the step of:

f) activating a subset of the multiple of wind machines the multiple of wind machines in response to the real time ambient meteorological condition as sensed, and the real time condition of plant operation as sensed.

8. The wind machine array method of claim 1, further comprising the step of:

f) varying a fan speed in response to the real time ambient meteorological condition as sensed, and the real time condition of plant operation as sensed.

* * * * *